United States Patent [19]

Menzel et al.

[11] Patent Number: 4,772,367

[45] Date of Patent: Sep. 20, 1988

[54] APPARATUS FOR AND A METHOD OF ELECTROCHEMICALLY POLISHING PIPE INSIDE SURFACES

[75] Inventors: Jügen Menzel, Munich, Fed. Rep. of Germany; Georg Henkel, Waidhofen/Thaya, Austria

[73] Assignee: Poligrat GmbH, Fed. Rep. of Germany

[21] Appl. No.: 47,653

[22] Filed: May 8, 1987

[30] Foreign Application Priority Data

May 20, 1986 [EP] European Pat. Off. ..... 86106812.0

[51] Int. Cl.[4] ..... C25B 3/02; C25D 17/14

[52] U.S. Cl. ..... 204/129.5; 204/224 M; 204/129.7; 204/225; 204/272

[58] Field of Search ..... 204/224 M, 225, 272, 204/129.6, 129.7, 129.5, 275

[56] References Cited

U.S. PATENT DOCUMENTS

| | | | |
|---|---|---|---|
| 2,764,540 | 9/1956 | Farin et al. | 204/224 M X |
| 3,055,812 | 9/1962 | Andersson | 204/225 X |
| 3,202,598 | 8/1965 | Covington et al. | 204/224 M |
| 3,429,787 | 2/1969 | Weinreich | 204/272 X |
| 4,369,101 | 1/1983 | Wolff et al. | 204/225 X |
| 4,601,802 | 7/1986 | Grimes et al. | 204/272 X |
| 4,632,740 | 12/1986 | Operschall et al. | 204/224 R X |

*Primary Examiner*—Donald R. Valentine

*Attorney, Agent, or Firm*—Woodard, Emhardt, Naughton, Moriarty & McNett

[57] ABSTRACT

An apparatus and a method serving for electrochemically polishing and/or pickling the inner surfaces (16) of pipes (10) provide for a polishing head (12) to be moved through the pipe. The polishing head (12) comprises a dielectric outer wall which defines a narrow working gap (28) together with the inner pipe surface (16) to be cleaned, the electrolyte flowing through said gap. This permits electrochemical polishing of high quality of the inside surface of the pipe with little consumption of electrolyte. The electrolyte stream may be divided into cathodic and anodic partial streams (30 and 32, respectively).

10 Claims, 1 Drawing Sheet

APPARATUS FOR AND A METHOD OF ELECTROCHEMICALLY POLISHING PIPE INSIDE SURFACES

The instant invention relates to an apparatus for electrochemically polishing and/or pickling the inner surfaces of pipes by means of an electrolyte stream which flows past at least part of a cathode disposed in the interior of the pipe connected as anode. The invention also relates to a corresponding method of electrochemically polishing and/or pickling pipe inside surfaces.

A method and an apparatus serving for the so-called electropolishing of the inside walls of metallic pipes are known from European patent application No. 82 104 945.9. In this case the electrolyte is applied under high pressure of approximately 50 bar to a partial section of the pipe wall. The cathode is moved in the pipe by means of the high pressure jet so that different sections of the inside wall of the pipe can be polished successively.

A method and an apparatus serving for electrochemically polishing the inside walls of pipes are known from European patent application No. 82 104 946.7. In this case an electrode acting as cathode is movable through the pipe. The electrolyte is filled into the entire pipe section which is to be subjected to electropolishing.

German utility model No. 80 11 918 discloses an apparatus for electropolishing the inner surfaces of pipes wherein a pipe lance is introduced into the pipe. Between its tip and a damming ring this pipe lance includes a cathodic area, and the pipe lance is provided with perforations through which passes the electrolytic liquid.

The state of the art of electrochemically polishing inner pipe walls of which some examples were given above, may be divided roughly into two classes:

(1) A through cathode is inserted into the pipe which is to be polished at the inside, and the electrolyte is pumped through the pipe which is connected as anode. During the electropolishing process, the pipe either is positioned horizontally or slightly inclined, while being rotated about its longitudinal axis. It is possible as well to place the pipe in a vertical position.

(2) A cathode is used which acts partially only on a respective section of the inner pipe wall (in other words, the cathode is much shorter than the pipe to be subjected to electropolishing), and this cathode is moved through the pipe. At the same time, the electrolyte is pumped through the pipe.

It is a disadvantage of the known methods and apparatus used for electrochemically polishing and/or pickling inner pipe surfaces that the electrolyte consumption is very high for the complete filling, flushing, and cooling of the pipe. Moreover, the gases (hydrogen and oxygen) formed during the electrolytic polishing must be discharged, and this again requires a very high rate of flow of the electrolyte through the pipe.

Furthermore, the known apparatus and methods may be applied in practice only with electrolytes whose metal content is subject to severe limitations. With the known apparatus an increased content of metal in the electrolyte will cause the cathode surfaces to become passive by coats of metal slurry which is deposited cathodically. The polishing quality suffers severely from such deposits. For this reason considerable amounts of electrolyte must be kept in circulation in order to maintain the metal content of the electrolyte at a low level.

It must be kept in mind also that the removal of the electrolyte enriched with metals involves enormous costs if it is not to be ecologically harmful. It is known to use mixtures of phosphoric acid, sulfuric acid, and water for electropolishing the inner surfaces of pipes made of austenitic steels containing chromium and nickel. These acids as such present a considerable threat and potential hazard to the surroundings so that special safety measures are required.

It is, therefore, an object of the instant invention to provide the means for electrochemically polishing and/or pickling the inner surfaces of pipes with a reduced amount of electrolyte. It is another object of the instant invention to provide a method of electrochemically polishing and/or pickling the inner surfaces of pipes which will result in improved quality of the polishing or pickling. It is likewise an object of the instant invention to permit the use of a much greater variety of electrolyte compositions.

The apparatus in accordance with the invention devised to meet the above objects is characterized by a polishing head which is movable through the pipe and comprises supply lines for the electrolyte and for electric power. A cathode is arranged in the interior of the polishing head. And a dielectric constitutes at least in part the outer wall of the polishing head, permits the electrolyte to pass, and leaves a working gap between itself and the inner pipe surface to be polished or pickled, the gap being free for passage of the electrolyte stream.

The method according to the invention by which the above objects are to be met is characterized in that the electrolyte stream is pumped into a polishing head provided with a cathode and out of the same through a dielectric into a working gap which is defined between the dielectric and the inner pipe surface.

This means that, in accordance with the invention, a polishing head is moved through the pipe. It is essential that a so-called working gap is defined between the wall made of a dielectric of the polishing head and the inside surface of the pipe, the electrolyte being pressed into the working gap through the dielectric.

The provision in accordance with the invention of a working gap between the dielectric and the inner surface of the pipe permits the quantity of electrolyte consumed to be reduced considerably as compared to the state of the art.

Furthermore, it was found that the combined electrochemical polishing and the wiping effect of the dielectric result in greatly improved performance of the electropolishing procedure and afford a polishing quality not to be obtained by conventional methods. Moreover, electrolytes may be used successfully which are quite different and above all much safer ecologically than conventional ones. Thus it is possible to use electrolytes which can be regenerated by ion exchangers or electrolytic decomposition cells. The metal content of the electrolyte at the same time may be kept so low that the cathode surfaces cannot become passive by depositing metal slurries.

A preferred variant of the invention provides for the electrolyte stream entering the polishing head to be divided into an anodic partial stream and a cathodic partial stream, the anodic partial stream flowing past the dielectric and the inner pipe surface but not past the cathode, while the cathodic partial stream flows past the cathode but not past the inner pipe surface.

This division of the electrolyte stream into anodic and cathodic partial streams is known with partial electrochemical polishing of free surfaces from the applicant's European patent application No. 86 105 747 which is not a prior publication. All the advantages mentioned in that publication apply to the polishing of the inside of pipes as well.

Further advantages of the invention will become evident from the subclaims.

The invention will be described further, by way of example, with reference to the accompanying drawings, in which.

A steel pipe 10, made for instance of chromium-nickel steel is to be cleaned and polished at the inside. To this end a polishing head 12 is moved slowly through the pipe 10. The polishing head 12 sometimes also is referred to as "tampon". The polishing head 12 is moved through the pipe 10 by a guide means 14 embodied by a tube of much smaller diameter than the pipe 10 to be cleaned.

Figure 1:
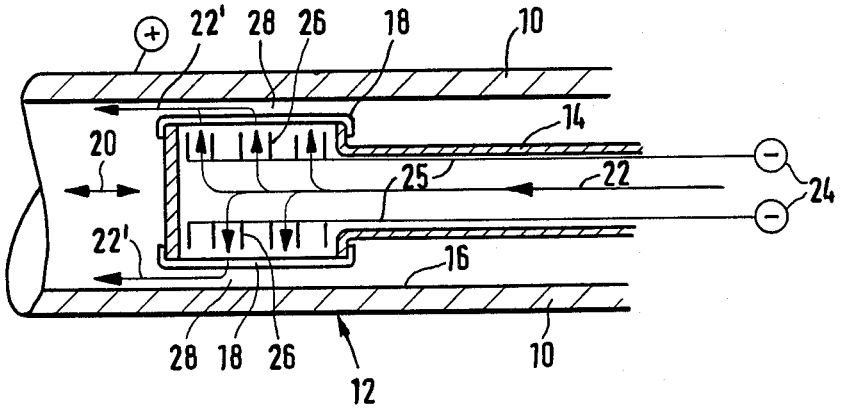
FIG. 1 is a sectional elevation of part of a pipe the inside surface of which is to be polished and also showing a polishing head which is movable in the pipe.
Figure 2:
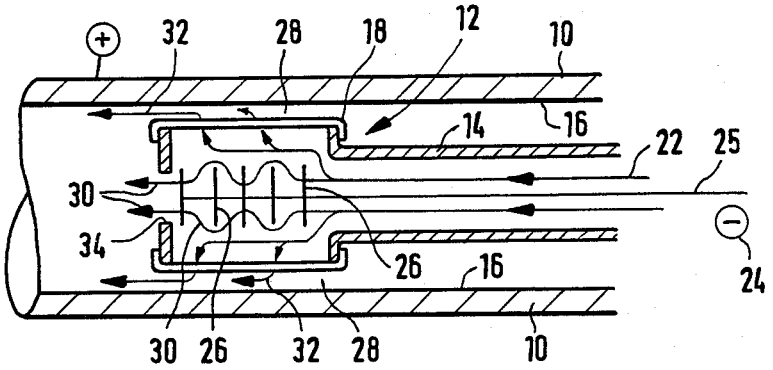
FIG. 2 is a sectional elevation corresponding to FIG. 1, showing a polishing head in which the electrolyte stream is divided into anodic and cathodic partial streams.

As shown in FIGS. 1 and 2, the polishing head 12 is approximately of cylindrical shape and positioned concentrically in the pipe 10 to be cleaned.

The jacket of the cylindrical polishing head 12 is formed by a dielectric 18 positioned throughout at a uniform spacing from the inner surface 16 of the pipe 10.

The polishing head 12 is movable in the direction of arrow 20, in other words in both directions through the pipe 10.

An electrolyte stream 22 enters the polishing head 12 from the right in FIGS. 1 and 2 through the guide means 14 and is pressed radially outwardly through the dielectric 18 as indicated by the arrows in the embodiment according to FIG. 1.

The electric supply lines 25 for the cathodes 26 are housed in the guide means 14 in the case of both embodiments shown in FIGS. 1 and 2.

A uniform, narrow working gap 28 is defined between the dielectric outer walls constituting the jacket of a cylinder of the polishing head 12 and the inner surface 16 of the pipe 10. As the electrolyte stream 22' flows through the working gap 28 it subjects the inner surface 16 in per se known manner to electrochemical abrasion and polishing.

In the case of the embodiment shown in FIG. 2, the electrolyte stream 22 entering the polishing head 12 is divided into a cathodic partial stream 30 and an anodic partial stream 32. The cathodic partial stream 30 flows past the cathodes 26 only but not past the dielectric 18 and the working gap 28. Thus the hydrogen gas forming at the cathodes 26 is not conveyed to the dielectric 18 or to the inner surface 16 to be polished. In this manner it is prevented on the one hand that the dielectric 18 becomes loaded by hydrogen gas and, on the other hand, harmful effects of the hydrogen on the inner surface 16 are avoided.

As shown in FIG. 2, the anodic partial stream 32 passes the wall constituted by the dielectric 18 and the working gap 28, thereby effecting electrochemical polishing of the inner surface 16.

The cathodic partial stream 30 exits through an opening 34 in the front end wall of the polishing head 12 and is collected, just like the anodic partial stream 32. If desired, it may be recycled upon regeneration.

The dielectric 18 used preferably consists of textile polytetrafluoroethylene fabric. It is likewise possible to use glass fiber fabric and acid-resistant synthetic woven or non-woven material.

The dimensions of the polishing head 12 and especially of the dielectric 18 are adapted or selected in consideration of the respective given inner diameter of the pipe such that a working gap of optimum width is obtained.

What is claimed is:

1. An apparatus for electrochemically polishing and/or pickling the inner surfaces (16) of pipes (10) by means of an electrolyte (22) stream which flows past at least part of a cathode (26) disposed in the interior of the pipe (10) connected as anode, characterized by

- a polishing head (12) which is movable through the pipe and comprises supply lines (14; 25) for the electrolyte and for electric current,
- a cathode (26) arranged in the interior of the polishing head (12), and
- a dielectric (18) constituting at least partly the outer wall of the polishing head (12) and being arranged between said cathode (26) and said inner surface (16) of the pipe, permitting the electrolyte to pass, and leaving a working gap (28) between itself and the inner pipe surface (16) to be polished or pickled which gap in free for passage of the electrolyte stream (22', 32).

2. The apparatus as claimed in claim 1, characterized in that the polishing head (12) is at least approximately cylindrical in shape, the dielectric (18) forming, at least partly, the cylinder jacket.

3. The apparatus as claimed in claim 1, characterized in that the electrolyte stream (22) entering the polishing head (12) is divided into an anodic partial stream (32) and a cathodic partial stream (30), the anodic partial stream flowing past the dielectric (18) and the inner pipe surface (16) but not past the cathode (26) and the cathodic partial stream (30) flowing past the cathode (26) but not past the inner pipe surface (16).

4. The apparatus as claimed in claim 1, characterized in that a guide means (14) for the polishing head (12) is embodied by a tube through which pass the electric lines (25) for the polishing head and through which the electrolyte is pumped to the polishing head.

5. The apparatus as claimed in claim 1, characterized in that the polishing head (12) is supplied with electrolyte and electric current by way of an elastic hose line and is pulled through the pipe (10) by means of a rod or rope.

6. The apparatus as claimed in claim 1, additionally including means for variably controlling the application of pressure to press the electrolyte through the dielectric (18).

7. A method of electrochemically polishing and/or pickling the inner surfaces (16) of pipes (10), wherein an electrolyte flows past the inner pipe surface connected as anode, characterized in that the electrolyte stream (22) is pumped into a polishing head (12) provided with a cathode (26) and out of the same through a dielectric (18) into a working gap (28) defined between the dielectric and the inner pipe surface (16).

8. The method as claimed in claim 7, characterized in that the electrolyte stream (22) is divided in the polishing head (12) into an anodic partial stream (32) and a cathodic partial stream (30), the anodic partial stream flowing past the dielectric (18) and the inner pipe surface (16) but not past the cathode (26) and the cathodic partial stream (30) flowing past the cathode (26) but not past the dielectric and the inner pipe surface (16).

9. The method as claimed in claim 7, characterized in that the polishing head (12) is moved through the pipe (10).

10. An apparatus for electrochemically polishing and/or pickling the inner surfaces (16) of pipes (10) by means of an electrolyte (22) stream which flows past at least part of a cathode (26) disposed in the interior of the pipe (10) connected as anode, characterized by a polishing head (12) which is movable through the pipe and comprises supply lines (14; 25) for the electrolyte and for electric current, a cathode (26) arranged in the interior of the polishing head (12), and a dielectric (18) constituting at least partly the outer wall of the polishing head (12), permitting the electrolyte to pass, and leaving a working gap (28) between itself and the inner pipe surface (16) to be polished or pickled which gap is free for passage of the electrolyte stream (22', 32), and wherein the electrolyte stream (22) entering the polishing head (12) is divided into an anodic partial stream (32) and a cathodic partial stream (30), the anodic partial stream flowing past the dielectric (18) and the inner pipe surface (16) but not past the cathode (26) and the cathodic partial stream (30) flowing past the cathode (26) but not past the inner pipe surface.

* * * * *